US007947165B2

(12) United States Patent
Berkowitz et al.

(10) Patent No.: US 7,947,165 B2
(45) Date of Patent: May 24, 2011

(54) METHOD FOR EXTRACTING AND UPGRADING OF HEAVY AND SEMI-HEAVY OILS AND BITUMENS

(75) Inventors: Brian Berkowitz, Mazkeret Batya (IL); Ishai Dror, Shoham (IL); Stephen Dunn, Calgary (CA)

(73) Assignee: Yeda Research and Development Co.Ltd, Rehovot (IL)

( * ) Notice: Subject to any disclaimer, the term of this patent is extended or adjusted under 35 U.S.C. 154(b) by 877 days.

(21) Appl. No.: 11/225,884

(22) Filed: Sep. 14, 2005

(65) Prior Publication Data

US 2007/0056881 A1 Mar. 15, 2007

(51) Int. Cl.
*C10G 29/02* (2006.01)

(52) U.S. Cl. ..... 208/106; 208/208 R; 208/251 R; 208/254 R; 208/298; 208/952

(58) Field of Classification Search ..... 208/179, 208/192, 390, 952, 106, 208 R, 251 R, 254 R, 208/298
See application file for complete search history.

(56) References Cited

U.S. PATENT DOCUMENTS

| | | | | |
|---|---|---|---|---|
| 4,005,005 | A * | 1/1977 | McCollum et al. | 208/391 |
| 4,341,619 | A * | 7/1982 | Poska | 208/390 |
| 4,446,012 | A | 5/1984 | Murthy et al. | |
| 4,485,003 | A | 11/1984 | Coenen et al. | |
| 4,818,370 | A | 4/1989 | Gregoli et al. | |
| 4,840,725 | A * | 6/1989 | Paspek | 208/130 |
| 5,096,567 | A | 3/1992 | Paspek et al. | |
| 5,316,659 | A | 5/1994 | Brons et al. | |
| 5,326,456 | A | 7/1994 | Brons et al. | |
| 5,338,442 | A | 8/1994 | Siskin et al. | |
| 5,611,915 | A | 3/1997 | Siskin et al. | |
| 5,635,056 | A | 6/1997 | Brons et al. | |
| 5,695,632 | A | 12/1997 | Brons et al. | |
| 2003/0062163 | A1 * | 4/2003 | Moulton et al. | 166/302 |
| 2003/0168381 | A1 * | 9/2003 | Hokari et al. | 208/106 |
| 2008/0099377 | A1 * | 5/2008 | He et al. | 208/264 |

FOREIGN PATENT DOCUMENTS

| | | |
|---|---|---|
| CA | 2000251 | 4/1991 |
| CA | 2103508 | 2/1994 |
| CA | 2220800 | 11/1998 |
| CA | 2208046 | 1/1999 |
| CA | 2242774 | 2/2000 |
| CA | 2252218 | 5/2000 |
| CA | 2316084 | 2/2002 |

(Continued)

OTHER PUBLICATIONS

Clark, Jim. Phase diagrams of pure substances. 2004. http://www.chemguide.co.uk/physical/phaseeqia/phasediags.html.*

(Continued)

*Primary Examiner* — Walter D Griffin
*Assistant Examiner* — Renee Robinson
(74) *Attorney, Agent, or Firm* — Pearl Cohen Zedek Latzer, LLP; Mark S. Cohen

(57) ABSTRACT

Improvements in the selective extraction of relatively low molecular weight oils from coal, coal liquids, oil shales, shale oils, oil sands, heavy and semi-heavy oils, bitumens, and the like are provided by a continuous process involving contacting the material to be treated with supercritical water in a continuous operation at pressures of from 500 psi to 3000 psi, temperatures of 250° C. to 450° C., and in-reactor dwell times generally in excess of 25 seconds and up to 10 minutes.

17 Claims, 5 Drawing Sheets

General Flow-Through System with Oil Preheater

FOREIGN PATENT DOCUMENTS

| | | | |
|---|---|---|---|
| CA | 2316084 | * | 8/2002 |
| CA | 2316084 A1 | | 3/2007 |

OTHER PUBLICATIONS

N. Berkowitz et al., "On 'Partial' Coal Conversion by Extraction with Supercritical H2O", Fuel Processing Technology, 16 (1987) 245-256.

N. Berkowitz et al., "Extraction of Oil Sand Bitumens with Supercritical Water", Fuel Processing Technology, 25 (1990) 33-44.

M. Ogunsola et al, "Exracton of oil shales wth sub- and near-critical water", Fuel Processng technology, 45 (1995) 94-107.

* cited by examiner

METHOD FOR EXTRACTING AND UPGRADING OF HEAVY AND SEMI-HEAVY OILS AND BITUMENS

FIELD OF THE INVENTION

Selective extraction of components from a raw feedstock with a supercritical fluid—in effect, a fractionation of the feed—is well known and at present widely used in commercial production of pharmaceuticals, perfumes and spices as well as in the manufacture of prepared foodstuffs such as caffeine-free coffee. The extractor fluids deployed in these operations are usually supercritical carbon dioxide or propane.

More recently substantial R & D has centered on the use of "supercritical water" for generating from coal, oil shales and oil sands relatively low-molecular-weight oils or oil precursors that are amenable to conventional upgrading or refining techniques.

We have found that, like heavier fossil hydrocarbons, heavy oils can also be upgraded to refinable crude oils by interaction with supercritical water. But the extent to which the average molecular size, and hence the viscosity of these feedstocks, is reduced is critically dependent on operating conditions, and these in turn, are directly governed by the chemical reactions that accompany processing.

This invention has to do with a novel method of processing heavier fossil hydrocarbons or heavy oils utilizing nominally supercritical water to obtain lower viscosity hydrocarbons with notably less coke.

BACKGROUND OF THE INVENTION

It is known to use supercritical water in processes which attempt to upgrade complex hydrocarbons, notably bitumen and heavy oils. Various processes are noted below, but each has drawbacks, described below, at least some of which this invention overcomes.

PRIOR ART

Brons (U.S. Pat. No. 5,695,632) deals with removal of sulfur and other organically bound heteroatoms and metals from heavy oil. The heavy oil is contacted with aqueous sodium hydroxide and subsequently water (and optionally hydrogen) at temperatures in the range 380° C.-450° C., to produce sodium sulfide, which is subsequently removed from the mixture. Reaction times are about 5 minutes to 3 hours. When hydrogen is added to the system, pressures range from 50-700 psi; otherwise, pressure is not defined. The teaching of the use of water at temperatures which may be near to supercritical to upgrade heavy oil by removal of sulfur and metals is of some interest.

Brons (U.S. Pat. No. 5,695,632) is limited to removal of undesirable components (namely organically bound sulfur, heteroatoms and metals) from a heavy oil feedstock. The Brons invention does not deal with the upgrading of heavy oil to unrefined crude oil quality, especially with regard to favorable changes in viscosity and density. Moreover, sodium sulfide is corrosive and difficult to handle. Handling of hydrogen at high pressures and temperatures is also difficult. There are therefore limits to the usefulness of Brons's (U.S. Pat. No. 5,695,632) invention as disclosed.

Brons (U.S. Pat. No. 5,635,056) is similar to Brons (U.S. Pat. No. 5,695,632) in that it deals with removal of a class of organically-bound sulfur and metals from heavy oil. This patent specifies a different class of such components. Operating conditions and methodologies are similar to those specified in Brons (U.S. Pat. No. 5,695,632). Again, water is supplied together with a transition metal in an intermediate step to modify the end-stage. The disclosure notes, as an aside, that the asphaltene content, density and viscosity may also be reduced using the water-with-transitional-metal process. Brons (U.S. Pat. No. 5,635,056) does not provide for any specific pressure range, and emphasizes removal of undesirable components.

As in Brons (U.S. Pat. No. 5,695,632), the handling of sodium sulfide and hydrogen is difficult.

These two Brons patents (U.S. Pat. No. 5,635,056 and U.S. Pat. No. 5,695,632) rely fundamentally on mixing and reaction of heavy oil with aqueous sodium sulfide, and both suffer the difficulty of having to deal with corrosive sodium sulfide or the difficulty of obtaining hydrogen and the danger of handling high pressure and high temperature hydrogen.

Siskin (U.S. Pat. No. 5,611,915) deals with removal of heteroatoms from high asphaltene materials (such as from heavy oil production) and coal, to favorably lower molecular weights. The patent deals with use of supercritical water in the presence of CO at ≈500 psi-2700 psi, with water temperatures in the range of 400° C. to 600° C. The teaching of the use of supercritical water together with CO is of some interest.

This patent (Siskin (U.S. Pat. No. 5,611,915)) relies fundamentally on addition of CO, at high temperatures (400° C.-600° C.). No provision is made for any convenient apparatus design for mixing and processing the reactants. This patent teaches away from Berkowitz (CA 2,000,251), which it cites for use of CO to extract liquids from tar sands, by stressing only N and S removal. Siskin '915 in fact is limited in its scope by the prior Berkowitz patent application (CA 2,000,251) which already covers all of the subject-matter in Siskin, except that Berkowitz (CA 2,000,251) did not specifically mention N or S removal. Siskin is problematic in requiring high temperatures and the addition of CO, while not providing for any convenient process methodology. Siskin's contribution to the art in the '915 patent is limited to removal of N and S using a prior piece of art, namely Berkowitz's prior published Canadian application (CA 2,000,251).

Siskin (U.S. Pat. No. 5,338,443) deals with upgrading organic materials such as coal and oil shale, using water at sub-critical temperatures (200° C.-374.4° C.) in the presence of an acid catalyst. The patent explicitly emphasizes upgrading of coal and oil shale, and does not deal with tar/oil sands. Treatment times are 5 minutes to 1 week (with preference for 30 minutes-3 hours). A key requirement of this process is that for each contacting temperature, the corresponding pressure is the autogenous pressure, i.e., the pressure is kept higher than the critical one in order to maintain the water in liquid form, apparently in a closed reactor. Siskin (U.S. Pat. No. 5,338,443) is problematic in that it relies on addition of an acid catalyst in addition to the water, thus the process involves the expense and complexity of acquiring, stockpiling, handling and balancing catalyst. Moreover, the pressure corresponding to each temperature is high (e.g., Siskin requires a pressure of about 3199.6 psi at the critical temperature of 374.4° C.), necessitating expensive and dangerous processing equipment and techniques for its commercial operation; the invention as described does not specify maintaining the contacting water in liquid or supercritical form. There are problems with high temperature, high pressures, and the required use of a catalyst. Additionally, there are unanswered questions with respect to the form of the water during the reaction cycles, and there is a lack of specificity in the nature of the reactor required for the process described, although the maintenance of autogenous pressures leads to batch or closed-system apparati.

Coenen (U.S. Pat. No. 4,485,003) deals with processing coal to make a hydrocarbon liquid using supercritical water at 380° C.-600° C. in a high pressure reactor. Required pressures range from about 3800 psi to about 6500 psi, and the process also requires addition of hydrogen and a sodium or potassium salt as a catalyst to the coal. Contact times are 10-120 minutes. The teaching of the use of supercritical water to upgrade a fossil fuel to hydrocarbon liquid is of some interest; however, Coenen (U.S. Pat. No. 4,485,003) is problematic in that it requires the addition of expensive hydrogen and uses corrosive and difficult to handle salts as a necessary catalyst. It also deals with very high pressures, and somewhat lengthy process times.

de Bruijn (CA 2,103,508) discloses the use of a water-gas-shift (WGS) in a continuous process to thermally rearrange liquid oil molecules and thus reduce viscosity and density. The aim is to produce an oil/water emulsion with a sufficiently low viscosity and density to allow transport of the emulsion via pipeline. The process requires contact with CO or synthesis gas, together with a bifunctional catalyst (such as production fines), at temperatures in the range 250° C.-460° C. and pressures in the range 100-10,000 psi, and reactor residence times of 3 minutes to 10 hours. de Bruijn (CA 2,103,508) is problematic in that it relies on addition of a catalyst (together with CO or synthesis gas, and water). Moreover, de Bruijn emphasizes production of oil/water emulsion rather than cracking of the constituent oil molecules, and does not provide for a lowered viscosity hydrocarbon reaction product, but rather an emulsion requiring further decomposition by additional processing steps to demulsify the reaction product and further separate the water and oil into useful components. Very high operating pressure and temperature conditions are also required.

Gregoli (U.S. Pat. No. 4,818,370) uses a continuous reaction to upgrade heavy oil by injecting brine at supercritical conditions. The aim is to lower the API gravity (density) and viscosity of the hydrocarbon feedstock, as well as to reduce the sulfur, nitrogen and heavy metal content. "Brine" refers, in Gregoli, to captured or connate water from the formation. Specified operating temperatures and pressures are about 376° C.-482° C. and 3400-4000 psi, respectively, while reactor residence times range from 15 minutes to 6 hours. Gregoli (U.S. Pat. No. 4,818,370) relies on relatively long reactor residence times and very high pressure and temperature ranges for operation. In particular, both the pressure arid residence time ranges are high, causing some process delay and complexity to required equipment. Gregoli contemplates that the continuous reaction be accomplished in situ in a production well, by introduction of heated brine and withdrawal of reaction products after a designed dwell-time in situ at desired pressures and temperatures which are quite high. The teaching leads to the use of connate water with included or dissolved minerals, thus contemplating a catalyst-like added feature to the near supercritical brine. Connate water may vary significantly from production well to production well in its composition (chemicals in addition to the water), and in situ conditions may be difficult to maintain and expensive and difficult to control or predict.

Enomoto (CA 2,220,800) cites as an essential element the injection of water/steam into a well, and the return of mixed oil and water/steam, prior to treatment in a reactor system. The processing thus cannot begin except at the production well-site, and is thus constrained in the location of at least some of its apparatus, and by definition uses at least two reaction chambers (the well and a reactor system), and perhaps requires more. Enomoto (CA 2,220,800) contemplates either heavy oil premixed with water, preferably underground (in an oil reservoir or well), and then heating/pressurizing of the mixture; high-temperature water is then added to the system. There are a great number of individual steps and stages to the processes disclosed. Because Enomoto considers an in situ system, pressure and temperature ranges are not well defined nor well controlled. In broad terms, they range from 71-1420 psi and 20° C.-350° C., respectively, and thus near supercriticality of the water used is not important for the entire reaction process as specified.

For the portion of the disclosure dealing specifically with the use of supercritical water in the upgrading process, Enomoto prefers a temperature range of 300° C.-500° C. in a very high pressure range, most preferably of 2840-7100 psi. Enomoto discusses an in situ system with several steps, but actually discloses tests performed in a batch mode (i.e., in a closed, and not continuous, system of autoclaves). The test data disclosed uses high operating conditions of 430° C., a high pressure 6390 psi, and reaction times of 5, 15, 30 minutes (actually the in-system dwell time is longer by an unspecified amount of time, because this is the time described for reaction AFTER REACHING the target temperature by heating in the autoclave over an unspecified preparation time). The Enomoto disclosure may not be workable, discloses a system and process using a number of different reaction chambers, pre-mixes and then heats the hydrocarbon and water, and deals with high pressures, high temperatures, and long in-system dwell times.

Furthermore, Enomoto (CA 2,220,800) specifies a system in which water from the reactor system is removed in a phase separator while at high temperature, thus requiring the treatment and handling of high temperature water and hydrocarbons, which may also be problematic, dangerous and complex, requiring specialized techniques and equipment.

Brons (U.S. Pat. No. 5,316,659) deals with upgrading of bitumen asphaltenes obtained from oil sands. The method involves separating solid asphaltene materials from whole bitumen that is recovered from tar sands. Solvent de-asphalting of the whole bitumen is achieved using a C3-C5 aliphatic hydrocarbon solvent such as propane or butane. The precipitated asphaltenes are then contacted with water at temperatures of 300° C.-425° C. but at no particular pressure and for no particular reaction time, in order to produce material with a lower average molecular weight. Examples mention reactions in an autoclave, with reactions at 350° C. and 400° C. over 2 hours. Brons (U.S. Pat. No. 5,316,659) requires a key addition of a de-asphalting solvent to separate asphaltenes from the whole bitumen, and then uses heated water to treat only the resulting asphaltenes. Thus, there are required two separate reaction stages, involving quite different reactions (solvent de-asphalting of the whole bitumen and then upgrading of the resulting asphaltenes). The reaction time is quite lengthy, and the process appears to be done in batches.

Brons (U.S. Pat. No. 5,326,456) is identical to Brons (U.S. Pat. No. 5,316,659), except that it specifies the addition of a soluble carbonate salt, and possibly a transition metal oxide, to the water. These additions further improve the quality of the product. Otherwise, the two disclosures share the same shortcomings.

Paspek (U.S. Pat. No. 5,096,567) deals with a process of upgrading heavy hydrocarbons. The method of this invention features production of an oil/water emulsion to permit pipeline transfer of the heavy hydrocarbons, together with a method to process the emulsified oil feedstock to obtain light hydrocarbon products. The method first requires as an essential element the premixing of the oil feedstock and an immiscible solvent (predominantly water) to form. an emulsion with specified oil droplet sizes. While the claims indicate that use only of water as the immiscible solvent is sufficient, it is known that heavy oils will not typically form an emulsion with water (and certainly not in the small range of droplet sizes indicated in the patent) without the addition of some surfactant or other such component. Thus, it will be inferred and understood that Paspek (U.S. Pat. No. 5,096,567) requires the addition of some surfactant or other similar material, or rely upon some other unspecified process step in order to work as otherwise described.

Other parts of the Paspek (U.S. Pat. No. 5,096,567) patent advocate the addition of emulsifying materials such as short-chained alcohols, salts, or other catalysts such as ruthenium carbonyl. The addition of one or more of these catalysts is key, but adds expense, complexity and the need for other materials to the processes involved. The emulsion is subsequently heated in a reactor system and the lighter hydrocarbons are separated. Paspek (U.S. Pat. No. 5,096,567) mentions reaction temperatures in the range 350-1000° C., but preferably in the range 450° C.-500° C. Reaction pressures are not specified, but the embodiment teaches pressures in the range of 3000-5000 psi. It can therefore be appreciated that high temperatures, high pressures and complex additives are concerns with the Paspek (U.S. Pat. No. 5,096,567) invention. Furthermore, Paspek teaches a reaction time of 30 minutes, which means that the reaction process described will involve a lengthy processing time. It is noted that the suggestion for use of an immiscible solvent mixed or replaced by short-chained alcohols or other emulsifying materials as a preferred embodiment teaches away from use only of water as the immiscible solvent, and in particular away from the use of supercritical water as a satisfactory solvent on its own, thus introducing the need, in the preferred embodiment, of additives and more complex processes.

Murthy (U.S. Pat. No. 4,446,012) deals with upgrading of heavy hydrocarbons into light hydrocarbons by contacting the feedstock with water at temperatures in the range of 380° C.-480° C. (most preferably between 430° C.-460° C.) and at pressures in the range of 725-2175 psi. An essential element of the patent is use of two reaction zones—the first to heat the hydrocarbon and water simultaneously to produce a uniform mixture, and the second in which the temperature and pressure are maintained for some time while the uniform mixture is separated into a residue and a vapor phase comprised of a mixture of light hydrocarbons, gas and water. The residue is removed from this second zone and the light hydrocarbon is then recovered from the remaining materials in a phase separation vessel. Thus, the system requires at least two separate zones with separate characters in its reactions.

Another critical feature of this patent is that the specified range of temperature and pressure is maintained in both the first and the second zones. Separation of the hydrocarbon, gas and water mixture occurs only subsequently, after the residue is first removed. Residence times in the continuous flow system range from a few minutes to 20 minutes. Murthy (U.S. Pat. No. 4,446,012) is unique in its essential requirement of two separate reaction zones, in its maintenance of high pressures and temperatures in both zones, and in its method to separate and recover a light hydrocarbon phase. Also, the hydrocarbon and water are first mixed and only then heated, apparently to provide a uniformity of the mixture. Murthy requires, in addition to the two separate zones of different character (and thus complex control and sensing mechanisms in the processing apparatus), high temperatures for its processes, and deals with the removal of light and vaporous hydrocarbons as part of the processing stages, thus introducing some further complexity in materials handling and concerns with safe handling of pressurized hydrocarbon vapors at high temperatures.

RELATED PUBLICATIONS

The present application is based in part on and involves improvements over published Canadian applications 2,208,046; 2,242,774; 2,252,218; and 2,316,084, all incorporated by reference to the extent consistent with the present disclosure.

SUMMARY OF THE INVENTION

Supercritical water is fluid water brought by a combination of heat and pressure to the point at which, as a near vapor, it combines properties of a gas and a liquid.

Unlike supercritical propane or carbon dioxide, supercritical, near-supercritical, and nominally-supercritical water (hereinafter "supercritical water" or SCW) exists only at temperatures of 250° C.-450° C. or more and at such temperatures, high molecular weight hydrocarbons are prone to thermal decomposition. Such degradation, synonymous with cracking, tends to increase with time at reaction temperatures and as a rule entails two net reaction sets, one generating gas and another yielding high molecular weight carbonaceous products loosely termed coke.

As is apparent from the background information above, there are numerous disadvantages to processes and process equipment used in the prior art to upgrade high molecular weight hydrocarbons such as heavy and semi-heavy oils, hydrocarbons recovered from tar sands and oil shales, coals, coal liquids, oil sand, bitumens, shale oils, oil precursors and other bitumens (all of which are referred to below as "high molecular weight hydrocarbons"). We note that hydrocarbons recovered using conventional Steam Assisted Gravity Drainage (SAGD) production processes for heavy oil production may contain some water, which is not deleterious to the processes of this invention; thus hydrocarbons with water from SAGD recovery processes are included amongst the potential feedstocks for the process of this invention.

It is apparent, as well, that the term "upgrading", when used in the description of this invention and in the claims, means both upgrading of heavy and semi-heavy oils to unrefined crude oil quality in aspects of viscosity, density, and/or molecular weight, as well as possible reduction in sulfur, nitrogen and/or metal concentrations, but also means extraction of acceptable oils and oil precursors from oil sand bitumens, coals, coal liquids, oil shales, shale oils, and other bitumens as referenced above, possibly pretreated, "acceptable oils and oil precursors" being defined as hydrocarbons suitable for conventional transport and processing/refining.

In particular, problems with the prior art processes and equipment arise where complex multi-reactor or multi-step devices or processes are used, additives such as connate water or catalysts are required, coke by-products or caustic or dangerous chemicals are produced, or other problems as identified above are encountered.

In the presence of nominally supercritical water, we find that these processes are also accompanied by thermally-driven hydrolysis of the general form:

$$R—R'+H_2O \Rightarrow R—H+R'—OH$$

This is, however, reversible because —C—OH is inherently unstable under reaction conditions, and thus represents a transient process. Maximizing the hydrolyzed reaction product and concurrently inhibiting extreme thermal cracking, which yields gas and coke by random radical recombinations, therefore requires an empirically established compromise between reaction temperature, pressure and the in-reactor residence time of [R—H], [R'—OH] and other species sufficiently degraded to be 'soluble' in SCW. While it is therefore desirable to minimize the in-reactor residence time for both maximizing production rate and minimizing coke formation, it has been found that for practical reasons in-reactor residence times of less than 25 seconds are often inadequate to accomplish the objectives of the present invention.

These considerations, confirmed by data from an extensive series of laboratory tests, lead us to the conclusion that a simple stirred pressure-reactor precludes optimal hydrocarbon upgrading with supercritical water. The water used in making supercritical water for use in the present invention can be, but is not limited to, tap water, distilled water, de-ionized water, river water, lake water, ground water, and the like, and/or can comprise or consist of water retrieved from the cooling system and/or the collection vessel, and any such water used may contain small amounts of accompanying salts and/or minerals.

It is an object of the present invention to obviate or mitigate at least one disadvantage of previous processes or process apparatus.

With respect to extraction and upgrading of oil from coals, coal liquids, oil shales, shale oils, and other similar sources of bitumens, prior art (Berkowitz and Calderon, 1987, 1990; Ogunsola and Berkowitz, 1995) has demonstrated that oil products can be extracted by exposing these feedstocks to hot water, and/or steam, and/or SCW. Exposure of crushed coal and/or oil shale material to SCW in the flow-through system of the current invention acts in the same manner to extract the oil, at which point upgrading (in terms of reducing viscosity and density) occurs as described herein.

A far more efficient system offers itself by use of a process and with an apparatus comprising an appropriately designed and scaled flow-through reactor in accordance with the following:

1. The apparatus of the invention is a flow-through reactor for upgrading high molecular weight hydrocarbons, the reactor comprises:

a. a single reaction chamber for maintenance of continuously introduced materials at operating temperatures between in the range of 250 to 300° C. and as high as 450° C., or even slightly more, and at operating pressures between 500 and 3000 psi, preferably 1000 to 3000 psi, more preferably 1000 to 2000 psi, still more preferably 1000 to 1500 psi, or in some cases alternatively 800-1500 psi, more preferably 900-1200 psi, while the materials are mixed and held inside the chamber for a desired amount of time;

b. a port for introducing water, including SCW, into the chamber under pressure in a continuous manner;

c. optionally and preferably, a preheater for the high molecular weight hydrocarbons which, if in the form of coal, shale or other bitumen sources, can have been subjected to pretreatment, e.g. by crushing into small particles, to facilitate their injection into the reactor system, and mixed in a slurry with water and/or other liquid hydrocarbons;

d. a port for introducing high molecular weight hydrocarbons into the chamber under pressure in a continuous manner, for example fed by a mechanical conveyor belt or train car system, or injected in a slurry of water and/or other liquid hydrocarbons;

e. an exit port to permit reaction products to leave the chamber under pressure in a continuous manner; and f. optionally, a port for introduction of pressurized CO or nitrogen, or optionally other gases, e.g. inert or inactive gases.

2. The process involves a flow-through reactor for upgrading high molecular weight hydrocarbons, the reactor having a single reaction chamber being held at pressures desirably in the range of about 500-3000 psi and temperatures in the range 250° C.-300° C. to about 450° C. while water and the hydrocarbons to be upgraded are introduced into the chamber, and then mixed, being held in the chamber for a predefined period of reaction time and thereafter the products of the resulting reaction are permitted to leave the chamber, all on a continuous basis during operation.

Other aspects and features of the present invention will become apparent to those ordinarily skilled in the art upon review of the following description of specific embodiments of the invention in conjunction with the accompanying figures.

DETAILED DESCRIPTION

Figure 1:
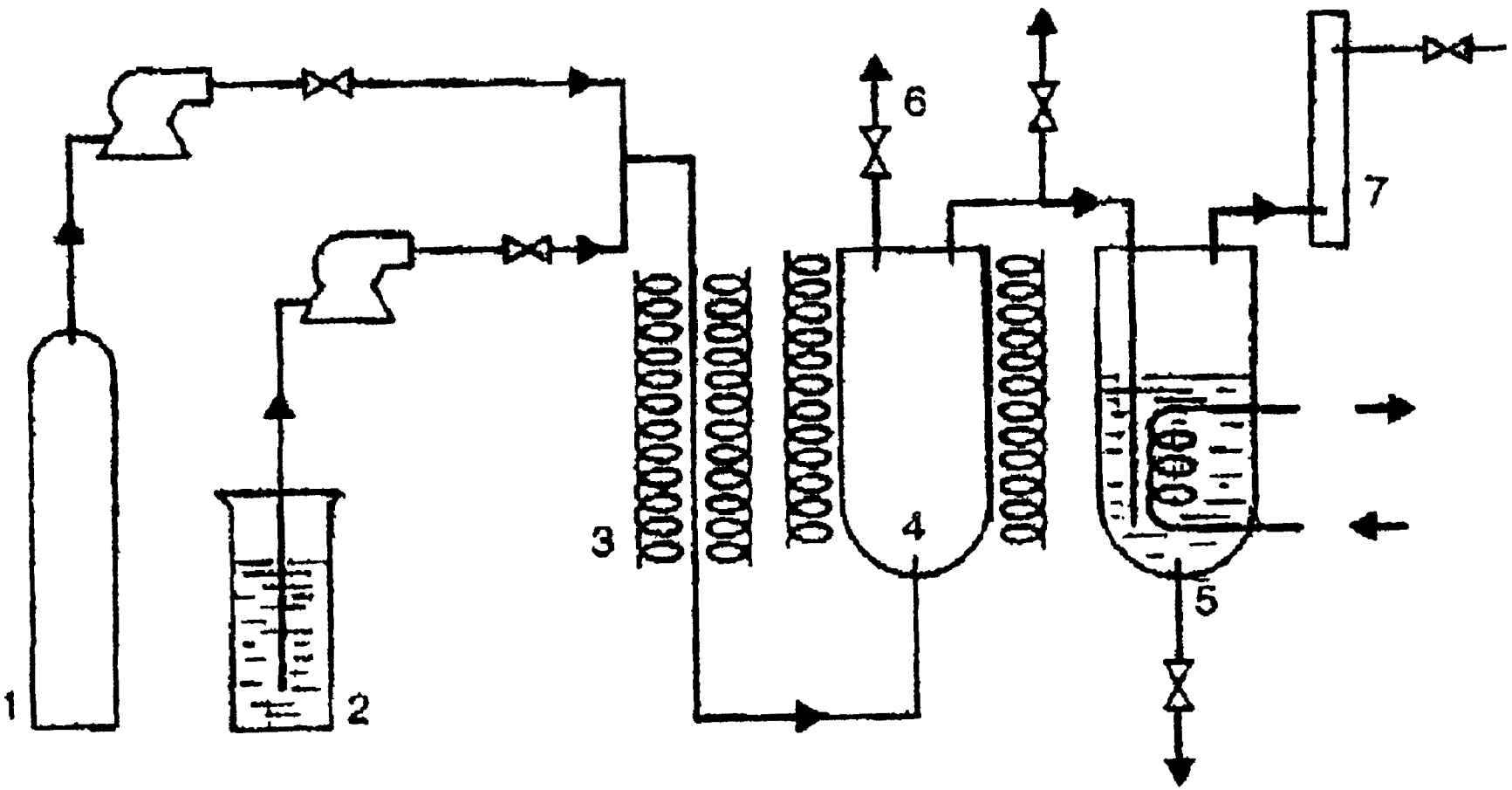
FIG. 1 shows a general flow-diagram charting the interrelationship of pieces of equipment in one embodiment.

The principal components of a suitable reactor of this type are exemplified in the attached diagram (FIG. 1). The numbering in that schematic diagram represents

1. optionally, high-pressure nitrogen or CO—the latter for enhancement of oil quality (see below);

2. water reservoir;

3. preheater in which the SCW is formed;

4. stirred reactor;

5. pressure letdown vessel;

6. sampling or gas release valve; and

7. activated carbon trap (or other gas collector).

The inlet to the reactor for the hydrocarbon feedstock is not shown, but is desirably between the preheater 3 and the reactor 4 or directly into the reactor 4.

In such a system, supercritical water, generated by pumping water from the reservoir 2 through the preheater 3, is injected into the reactor 4 at rates similar to those at which it and its entrained hydrocarbon load is withdrawn into the pressure letdown vessel 5 in order to maintain desired operating pressures in the reactor. The reaction can be followed by periodically sampling the exiting stream through a release valve 6, and uncondensed vapors as well as gaseous reaction products are captured as required in an appropriately cooled trap 7. Oils carried into the pressure letdown vessel are recovered by holding its pressure and/or temperature regime sufficiently below that of the reactor to allow the oils to fall out from then-sub-critical water, draining the oils, and substantially freeing them from uncondensed water by phase-separation.

The inclusion of a source of high-pressure carbon monoxide in the schematic reflects our finding that co-introduction of CO can in some instances—notably when the feedstock is predominantly aromatic—improve the quality of the product oil by increasing the proportion of aliphatics at the expense of aromatics and (hetero-atom bearing) polar compounds. Table 1 illustrates this with data for an Alberta bitumen and also show that pressures above 15-17 MPa, roughly 2200-2400 psi, can prove counterproductive.

TABLE 1

| | | 1 | 2 | 3 | 4 |
|---|---|---|---|---|---|
| Feed | | 36 | 11 | 37 | 16 |
| Reacted with | 400° C./14.0 MPa | 30 | 19 | 39 | 12 |
| $H_2O$ at | 400° C./17.9 MPa | 24 | 24 | 40 | 12 |
| | 400° C./24.5 MPa | 28 | 27 | 43 | 2 |
| Reacted with | 400° C./14.0 MPa | 74 | 5 | 19 | 2 |
| $H_2O$ + CO at | 400° C./17.9 MPa | 72 | 5 | 21 | 2 |
| | 400° C./24.5 MPa | 66 | 5 | 27 | 2 |

1. Aliphatics;
2. Aromatics;
3. Polar Compounds;
4. Asphaltenes $H_2O$/CO mole ratios in these runs ranged from 1.05 and 1.30 to 2.20

The reference to "hetero-atoms" means that the feedstock may contain sulfur, nitrogen and/or metals. By reducing the proportion of polar compounds from the feedstock, this process, "by definition", has the advantage of also removing sulfur, nitrogen and/or metals, when such hetero-atoms are present in the feedstock.

We have provisionally ascribed the intervention of CO to generation of active hydrogen by $$CO+H_2O \Rightarrow CO_2+H_2$$

or to an ionic reaction path of the form $$H_2O \Rightarrow H^+ + OH^-;\quad CO+OH^- \Rightarrow HCO_2^-;\quad HCO_2^- + H_2O \Rightarrow H_2CO_2 + OH^-;\ H_2CO_2 \Rightarrow H_2 + CO_2$$

As indicated above, the operating parameters are important. In particular, the sweep rate equivalent to in-reactor residence time should not exceed 10 minutes, and more preferably should not exceed about 60 seconds, but should exceed 25 seconds, and more preferably should be at least 28 seconds. For practical operation, the in-reactor residence time should more preferably be at least 35 seconds, and even more preferably at least 45 seconds. In the special case of operating temperatures below 300° C., e.g. 250-299° C., more preferably 250-295° C., the in-reactor residence time can be reduced to less than 25 seconds, i.e. any sweep rate below 10 minutes and preferably below 60 seconds.

The injection ratios of water to high molecular weight hydrocarbons feedstock material into the continuous flow-through reactor, as well as the preferred particle diameter of such a feedstock material when it is in solid form, such as crushed coal or crushed oil shale, can be adjusted according to the desired operating conditions, the nature of the feedstock material, the design of the flow-through reactor, and the chemical composition of the reaction products. While not constraining ourselves by any particular application and/or theory, the injection volume ratio of water to feedstock material may be varied in preferred embodiments from about 10:1 to about 1:10, and our tests reveal a preferred ratio of about 1:1 to about 1:5. When the feedstock material is a solid, it may be desirable to add a wetting agent, such as sodium silicate or other alkaline material, to aid the extraction of the oil from the oil sand, coal or oil shale.

Figure 2:
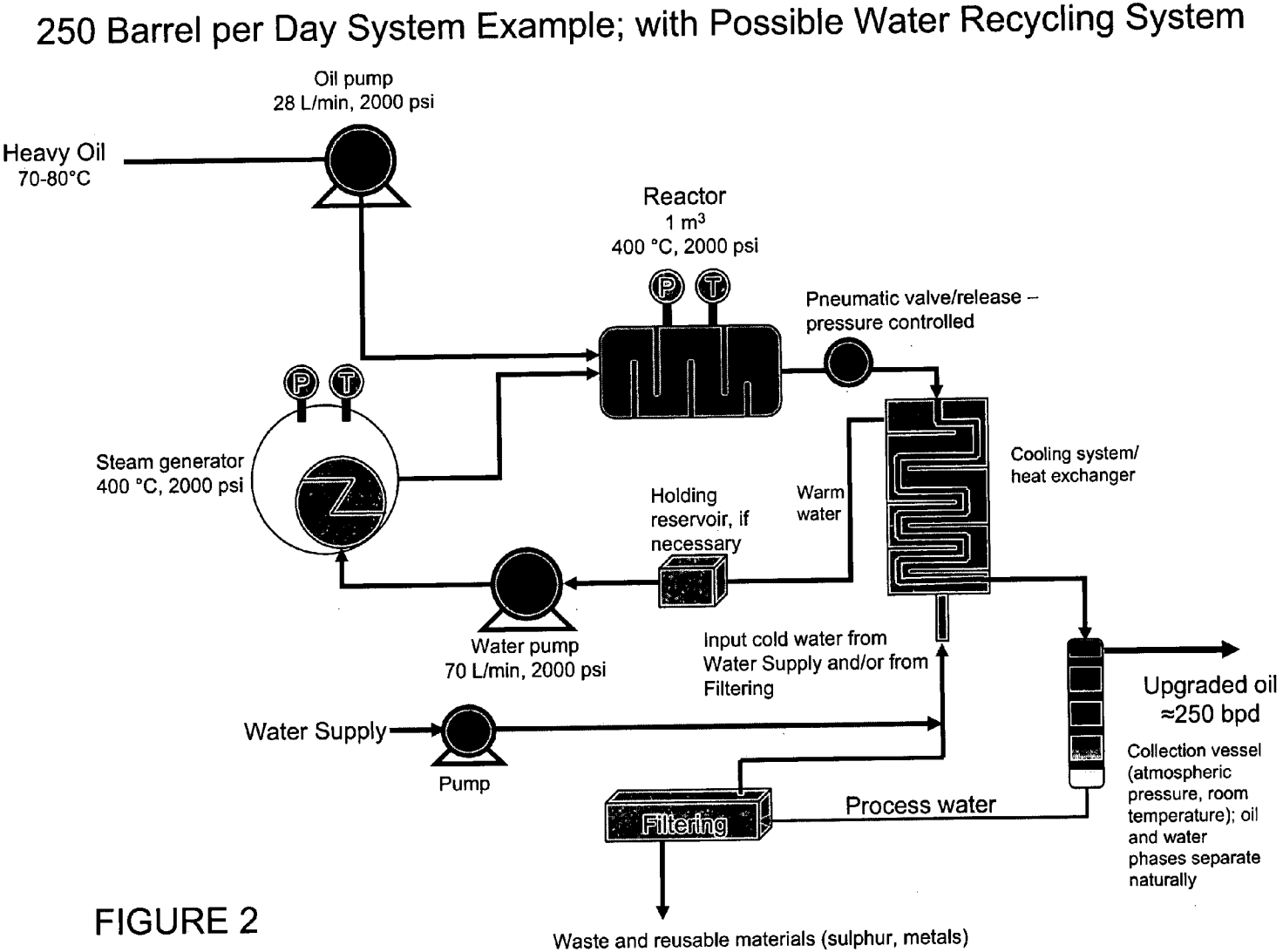
FIGS. 2-5 are flow diagrams of improved embodiments, with FIG. 2 showing a most preferred embodiment when the oil feedstock is already hot and entering the system directly from SAGD production well, or from a preheater in which the oil has been pre-heated to roughly 60-90° C. prior to injection into the main reactor. The parameters shown in FIG. 2 are exemplary only, not intended to be limiting.
Figure 3:
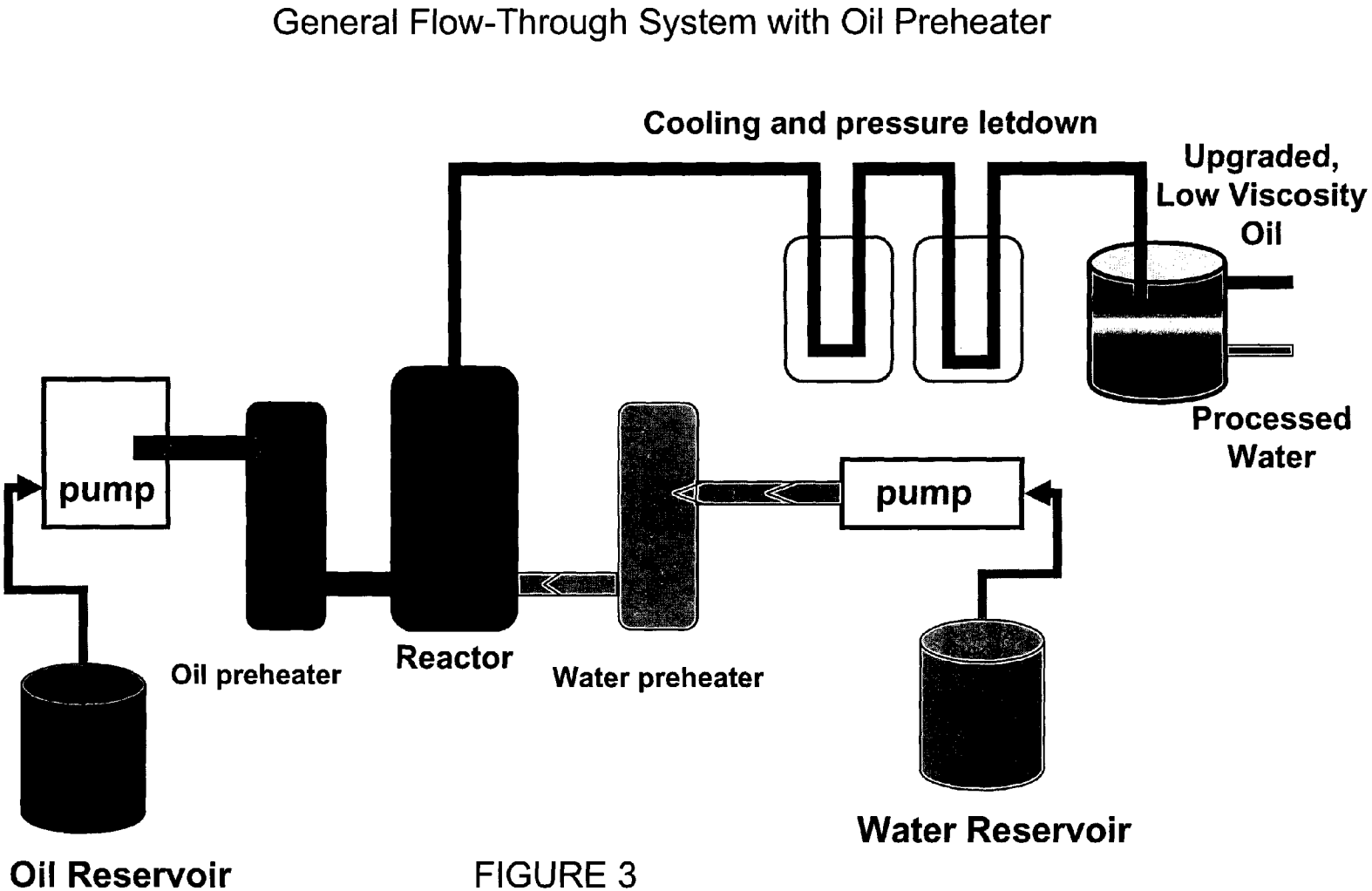
Figure 4:
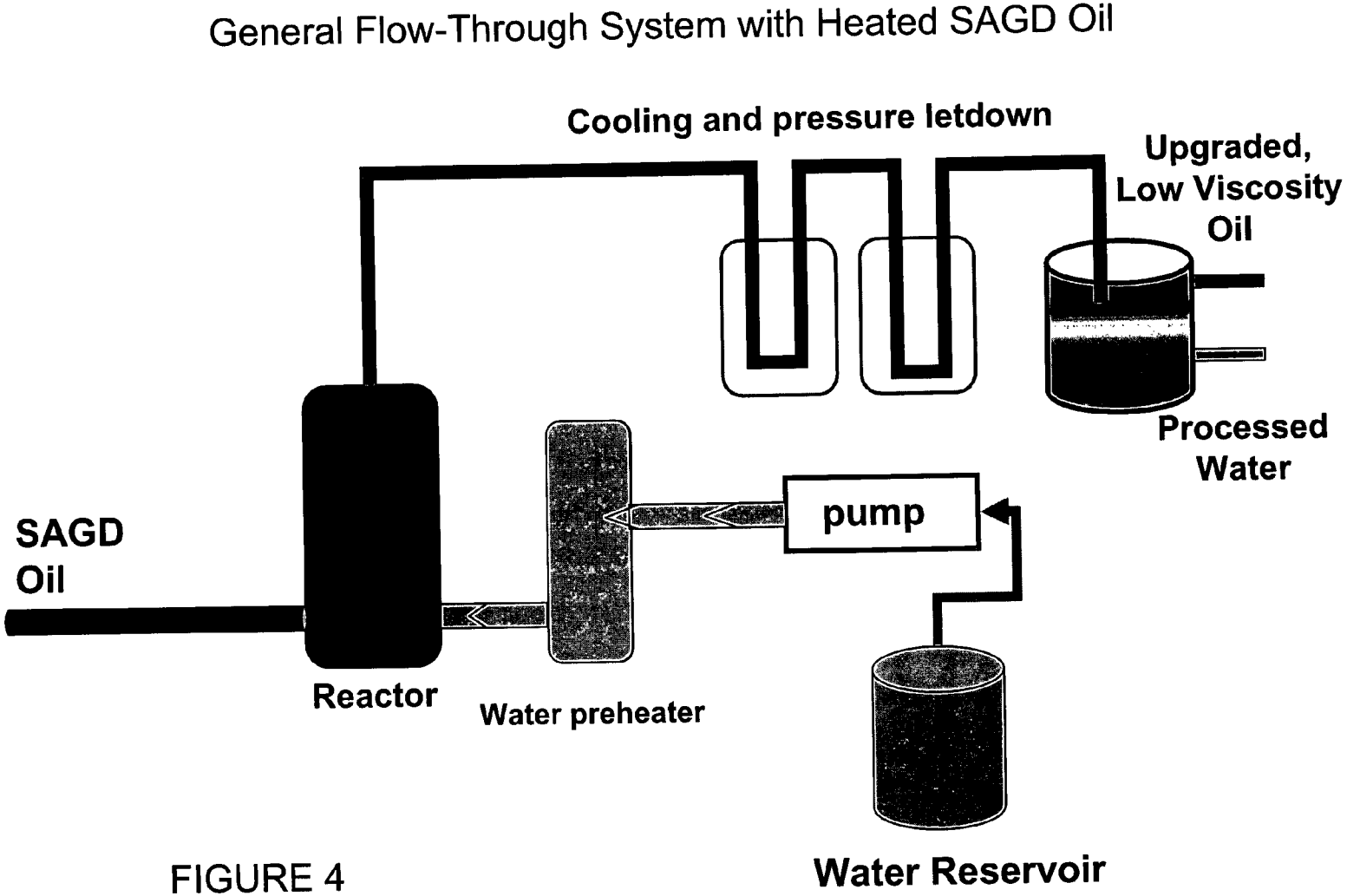

An important improvement according to the present invention is the provision of a cooling system/heat exchange as shown in FIGS. 2-5. As the hydrocarbon/water product exits the main reactor, it is desirably cooled prior to entering the collection vessel from a temperature as low as 250 or 300° C. up to about 450° C. In a preferred embodiment, the outlet tube from the main reactor is coiled and placed in one or more tanks or tubing sleeves of cooling water. This of course will heat the cooling water which, as shown in FIG. 2, is fed counter current to the product flow. The resultant warm water is then returned, e.g. pumped, to the steam generator as shown, or to a water preheating unit prior to injection into the oil-water reactor, and/or into a steam generating facility for SAGD injection. This reduces energy requirements for heating water.

An advantage to this approach is that the reactor outflow products can be cooled even to as low as room temperature, making the product easy to work with and reducing demands on the type of phase separator (oil, water, gas) required. In addition, the partially heated water from the heat exchanger fed to the steam generator or the preheating unit is "clean".

Another improvement involves treatment of the process water separated from the upgraded oil. As shown in FIG. 2, such process water is desirably sent to a filtering unit for removing contaminants which have been separated from the crude oil, such contaminants including sulfur- and/or nitrogen-containing compounds and metal complexes, among other contaminants. Thus, rather than discarding this dirty process water, it is subjected to filtering in the filtering unit, thus producing "clean" water which is then sent to the water preheating unit prior to injection into the oil-water reactor, and/or to the cooling system described above, and/or to a steam generation facility for SAGD.

Shown below in Table 2 are results achieved according to the present invention.

Table 2 shows upgrading of the raw hydrocarbon in terms of reduction in the relative resin and asphaltene component contents and concurrent increases in the relative contents of saturated and aromatic hydrocarbons. TLC/FID analyses of eight different treatments (in addition to analysis of the raw heavy oil), are presented. All samples were collected after in-reactor residence times of ~30 seconds (except for one experiment with a ~8 minute residence time). Operating parameters (i.e., temperature in ° C. and pressure in psi) for the main reactor are given for each treatment.

Most notable is the reduction in asphaltene content, which in some cases decreases to less than 2%; resin contents were reduced in some cases to less than 50% of their initial fraction. These reductions were compensated by increases mostly in the aromatic hydrocarbon content and to a lesser extent to a rise in the saturated hydrocarbons. Best results were achieved at high temperature and pressure combinations, but even at a pressure of 1000 psi a substantial reduction in asphaltene content was measured. Longer in-reactor residence times and the addition of CO (last two lines of table) to the reactor did not change significantly the resulting hydrocarbon composition.

TABLE 2

Changes in Hydrocarbon Composition

| Treatment | Saturates (%) | Aromatics (%) | Resins (%) | Asphaltenes (%) | Comments |
|---|---|---|---|---|---|
| Raw heavy oil | 29 | 46 | 14 | 11 | |
| 1000 psi; 300° C. | 27 | 51 | 12 | 10 | Experiment 1 |
| 1000 psi; 300° C. | 28 | 52 | 11 | 9 | Experiment 2 |

TABLE 2-continued

| Changes in Hydrocarbon Composition | | | | | |
|---|---|---|---|---|---|
| Treatment | Saturates (%) | Aromatics (%) | Resins (%) | Asphaltenes (%) | Comments |
| 1000 psi; 300° C. | 26 | 58 | 7 | 9 | residence time ~8 min |
| 1000 psi; 375° C. | 15 | 67 | 12 | 6 | |
| 1000 psi; 450° C. | 18 | 71 | 10 | 1 | Experiment 1 |
| 1000 psi; 450° C. | 26 | 65 | 8 | 1 | Experiment 2 |
| 2000 psi; 375° C. | 38 | 53 | 7 | 2 | |
| 2000 psi; 450° C. | 33 | 59 | 6 | 1 | |
| 3000 psi; 450° C. | 17 | 76 | 6 | 0 | |
| 1000 psi; 300° C., CO | 25 | 58 | 9 | 8 | |
| 1000 psi; 450° C., CO* | 31 | 56 | 8 | 4 | |

*Case 1000 psi. 450° C. NoCO produced considerable amounts of heavy coke material as well as low viscosity liquid. The values shown here are for the low viscosity liquid Table 3 demonstrates the effect of the present method on the physical properties of the resulting hydrocarbon (i.e., density and viscosity), as well as on the contents of other elements (sulfur, nickel and vanadium). Significant reductions in both viscosity and density are clear. Moreover, analyses of sulfur content, as well as nickel and vanadium concentrations, demonstrate that the present method forces undesirable heteroatoms from the hydrocarbon feedstock.

TABLE 3

| Reduction in Viscosity, Density, Sulfur Content, and Nickel/Vanadium Concentrations | | | | | | |
|---|---|---|---|---|---|---|
| | Viscosity | Density (23° C.) | | Sulfur | Ni | V |
| Treatment | (cSt) | (g/mL) | (API) | (% wt.) | (ppm) | (ppm) |
| Raw heavy oil | 9075.55 | 0.99 | 12 | 3.46 | 53.72 | 97.18 |
| 1000 psi; 300° C. | 675.05 | 0.91 | 24 | 3.44 | 39.16 | 84.70 |
| 1000 psi; 375° C. | 9.03 | 0.94 | 19 | 2.03 | 7.37 | 3.68 |
| 2000 psi; 450° C. | | | | 2.90 | | |
| 1000 psi; 300° C. | | | | 1.78 | | |
| 1000 psi; 450° C. | | | | 0.78 | | |

While Table 2 suggests that 1000 psi/300° C. and 1000 psi/3750 treatments to provide limited changes in composition, Table 3 indicates that these treatments had the greatest effect on density and viscosity of the resulting hydrocarbon. In repeated experiments, the 1000 psi/300° C. and 1000 psi/375° C. treatments consistently yielded hydrocarbons of "uniformly low viscosity" with little coke production.

It should be emphasized that the treatments presented here—as well as similar ones—should and can be optimized once target output parameters are prescribed.

Figure 5:
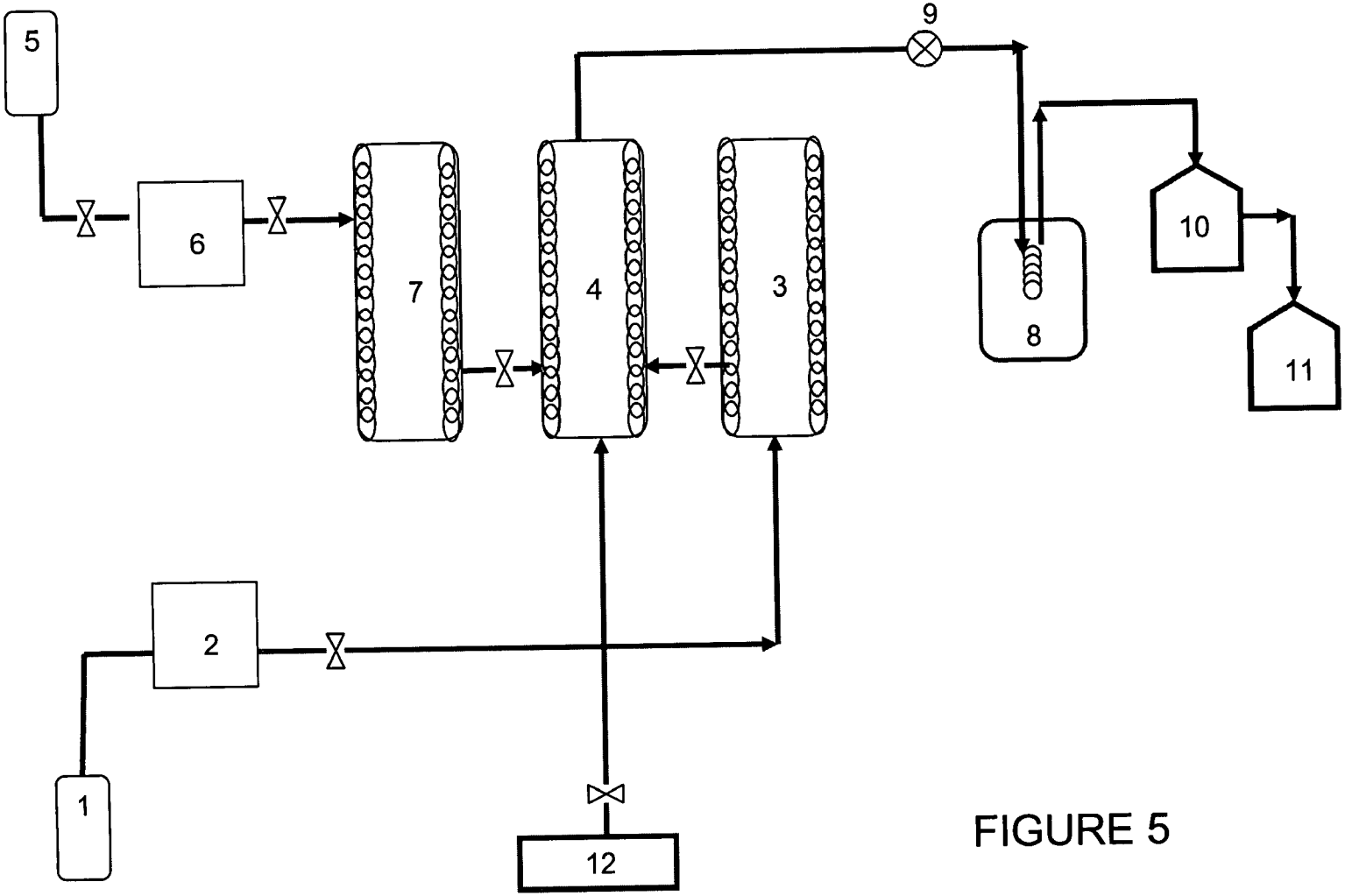

FIG. 5 describes a non-limiting embodiment of the present invention. The numbering in that schematic represents:

1. water reservoir;
2. water pump;
3. water preheater for SCW formation;
4. flow-through reactor;
5. hydrocarbon feedstock reservoir;
6. hydrocarbon feedstock pump;
7. hydrocarbon feedstock preheater (optional but preferred);
8. cooling system;
9. pressure release valve;
10. collection vessel;
11. activated carbon trap or other gas collector (optional); and
12. high-pressure carbon monoxide, nitrogen or other gas source (optional).

In such a system, SCW generated by pumping water from the reservoir (1) by a pump (2) to the preheater (3), is injected into the flow-through reactor (4). At the same time, oil feedstock material (e.g. heavy or semi-heavy oil, coal liquids, shale oils, or a slurry of oil sand bitumen, crushed coal, or crushed oil shale), is pumped from the reservoir (5) by a pump (6) to the (optional) preheater (7), and injected into the flow-through reactor (4). The rates at which the oil feedstock and the water are injected are variable, and selected to allow in-reactor residence times (in reactor (4)) of a few seconds up to 10 minutes, preferably at least 28 seconds and no more than about 60 seconds. The injected SCW together with its entrained hydrocarbon load flows through a cooling system (8), and through a pressure release valve (9) into a pressure letdown vessel (10).

The reaction and quality of the output product can be followed by periodically sampling the exiting stream in the collection vessel (10) itself, and uncondensed vapors as well as gaseous reaction products are captured (if required) in an appropriately cooled trap (11). Oils carried into the pressure letdown vessel are recovered by holding its pressure and/or temperature regime sufficiently below that of the reactor to allow the oils and any other reaction products to fall out from the then subcritical water, draining them and substantially freeing them from condensed water by phase separation.

Temperature and pressure gauges are attached to each of preheaters (3, 7) and to the flow-through reactor (4), to permit monitoring and control of the process. Each preheater (3, 7) and the flow-through reactor (4) contain heating elements to control liquid temperatures.

A preferred, but non-binding embodiment of the system is our use of a single (pressure-letdown) collection vessel, at the outlet of the flow-through reactor cell, in which product material is condensed, collected and passively separated. Additional collection vessels can be added in series to condense and/or capture any fugitive gases and other light hydrocarbon materials.

In some cases, it is beneficial to co-inject carbon monoxide or other gases into the system. This can be achieved through direct injection into the flow-through reactor (4), using a high-pressure source of CO or other gas (12) or through prior mixing with either the water in reservoir (1) and/or preheater (3), and/or through prior mixing with either the hydrocarbon feedstock in reservoir (5) and/or preheater (7). The inclusion of a source of high-pressure carbon monoxide reflects our finding that co-introduction of CO can in some instances—notably when the feedstock is predominantly aromatic—improve the quality of the product oil by increasing the proportion of aliphatics at the expense of aromatics and (heteroatom bearing) polar compounds. Use of nitrogen, for example, can assist in maintaining a constant in-reactor pressure.

A preferred, but non-binding embodiment of the system, is inclusion of a cooling system, at the outlet of the flow-through reactor (4): this system can consist of coiled tubing emplaced in cooling water tanks, to condense product material prior to product material collection in a vessel at (near) ambient (atmospheric) pressure and temperature conditions. A preferred but non-binding embodiment involves recycling water through these cooling tanks, with the partially heated water subsequently being fed into the water preheater (3), and/or into a steam generation facility for underground (SAGD) injection, to reduce energy requirements for heating water (i.e., increase the economic viability).

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. The means, materials, and steps for carrying out various disclosed functions may take a variety of alternative forms without departing from the invention.

Thus the expressions "means to . . . " and "means for . . . ", or any method step language, as may be found in the specification above and/or in the claims below, followed by a functional statement, are intended to define and cover whatever structural, physical, chemical or electrical element or structure, or whatever method step, which may now or in the future exist which carries out the recited function, whether or not precisely equivalent to the embodiment or embodiments disclosed in the specification above, i.e., other means or steps for carrying out the same functions can be used; and it is intended that such expressions be given their broadest interpretation.

REFERENCES

Berkowitz and Calderon, "On "Partial" Coal Conversion by Extraction with Supercrtical $H_2O$", *Fuel Processing Technology* 16:245-256 (1987)

Berkowitz and Calderon, "Extraction of Oil Sand Bitumens with Supercritical Water", *Fuel Processing Technology* 25:33-44 (1990)

Ogunsola and Berkowitz, "Extraction of Oil shales with sub- and near-critical water", *Fuel Processing Technology* 45:95-107 (1995)

What is claimed is:

1. A method for reducing the density, sulfur content, nitrogen content, metal content or any combination thereof, of materials bearing high molecular weight hydrocarbon, comprising:

a. introducing supercritical water into a single flow-through reaction chamber under pressure in a continuous manner, wherein said supercritical water refers to supercritical, near-supercritical, and nominally-supercritical water which exists at temperatures of 250 deg C.-450 deg C.;

b. introducing high molecular weight hydrocarbon into the reaction chamber under pressure in a continuous manner;

c. maintaining continuously introduced materials consisting essentially of said supercritical water and said high molecular weight hydrocarbon in said reaction chamber at operating temperatures of 250° C.-300° C. and at operating pressures between 500 and 2000 psi while said materials are mixed and held inside the chamber for a time of between 25 seconds to about 1 minute to provide a reaction substantially entirely between said high molecular weight hydrocarbon and said supercritical water; and d. permitting reaction products to leave said reaction chamber under pressure in a continuous manner.

2. The method of claim 1 comprising maintaining said materials inside said reaction chamber for an amount of time in excess of 28 seconds and not more than about 1 minute.

3. The method of claim 1 comprising maintaining said materials inside said reaction chamber for an amount of time in excess of about 30 seconds and not more than about 1 minute.

4. The method of claim 1, wherein said operating temperature is less than 299° C.

5. The method of claim 1, wherein said temperature is less than 295° C.

6. The method of claim 1, further comprising cooling the reaction products leaving said reaction chamber under pressure, using cooling water passing through a heat exchanger, and recirculating heated water leaving the heating chamber and/or reclaimed from the reaction process.

7. The method of claim 1, further comprising, prior to said introducing high molecular weight hydrocarbon into the reaction chamber, continuously preheating a continuous stream of said high molecular weight hydrocarbon.

8. The method of claim 1 where said water is pre-heated to a temperature of in the range of 250° C.-300° C. prior to its introduction into the reaction chamber.

9. The method of claim 1 where reaction conditions are controlled such that thermal cracking of the introduced high molecular weight hydrocarbon is minimized or if occurring is reversed so as to minimize the production of coke in the reactor.

10. The method of claim 1 where said high molecular weight hydrocarbon or material bearing high molecular weight hydrocarbon is one of: heavy oil, produced fluids from SAGD processes, oil sand high molecular weight hydrocarbons, coals, oil shales, coal liquids, shale oils, other high molecular weight hydrocarbons.

11. The method of claim 1 comprising maintaining said materials inside the reactor chamber for an amount of time of at least 45 seconds and not more than about 1 minute.

12. A method for reducing the viscosity, density, sulfur content, nitrogen content, metal content or any combination thereof, of materials bearing high molecular weight hydrocarbon, comprising:

a. introducing supercritical water into a single flow-through reaction chamber under pressure in a continuous manner, wherein said supercritical water refers to supercritical, near-supercritical, and nominally-supercritical water which exists at temperatures of 250 deg C.-450 deg C.;

b. introducing high molecular weight hydrocarbon into the reaction chamber under pressure in a continuous manner;

c. maintaining continuously introduced materials consisting essentially of said supercritical water and said high molecular weight hydrocarbon in the reaction chamber at operating temperatures between 250° C. and 300° C., and at operating pressures between 500 and 2000 psi, while said materials are mixed and held inside said reaction chamber for a time of between 25 seconds to about 1 minute, to provide a reaction substantially entirely between said high molecular weight hydrocarbon and said supercritical water;

d. permitting reaction products to leave said reaction chamber under pressure in a continuous manner; and e. cooling said reaction products leaving said reaction chamber under pressure, using cooling water passing through a heat exchanger, and recirculating heated water leaving the heating chamber and/or reclaimed from the reaction process.

13. The method of claim 12, further comprising, prior to said introducing high molecular weight hydrocarbon into the reaction chamber, continuously preheating a continuous stream of said high molecular weight hydrocarbon.

14. A method for reducing the density, sulfur content, nitrogen content, metal content or any combination thereof, of materials bearing high molecular weight hydrocarbon, comprising:

a. introducing supercritical water into a single flow-through reaction chamber under pressure in a continuous manner, wherein said supercritical water refers to supercritical, near-supercritical, and nominally-supercritical water which exists at temperatures of 250 deg C.-450 deg C.;

b. introducing high molecular weight hydrocarbon into the reaction chamber under pressure in a continuous manner;

c. maintaining continuously introduced materials consisting essentially of said supercritical water and said high molecular weight hydrocarbon in said reaction chamber at operating temperatures greater than 250° C. and less than 375° C., at pressures above 500 and below 2000 psi while said materials are mixed and held inside the reaction chamber for a time between 25 second to about 1 minute, to provide a reaction substantially entirely between said high molecular weight hydrocarbon and said supercritical water; and d. permitting reaction products to leave said reaction chamber under pressure in a continuous manner.

15. A method for reducing the viscosity, density, sulfur content, nitrogen content, metal content or any combination thereof, of materials bearing high molecular weight hydrocarbon, comprising:

a. introducing supercritical water into a single flow-through reaction chamber under pressure in a continuous manner, wherein said supercritical water refers to supercritical, near-supercritical, and nominally-supercritical water which exists at temperatures of 250 deg C.-450 deg C.;

b. continuously preheating a continuous stream of high molecular weight hydrocarbon;

c. introducing said preheated high molecular hydrocarbon into the reaction chamber under pressure in a continuous manner;

d. maintaining continuously introduced materials consisting essentially of said supercritical water and said high molecular weight hydrocarbon in the reaction chamber at operating temperatures between 250° C. and 375° C., at pressures between 500 and 2000 psi, while said materials are mixed and held inside said reaction chamber for a time between 25 seconds to about 1 minute, to provide a reaction substantially entirely between the high molecular weight hydrocarbon and the supercritical water; and e. permitting reaction products to leave said reaction chamber under pressure in a continuous manner.

16. A method for reducing the viscosity, density, sulfur content, nitrogen content, metal content or any combination thereof, of materials bearing high molecular weight hydrocarbon, comprising:

a. introducing supercritical water into a single flow-through reaction chamber under pressure in a continuous manner, wherein said supercritical water refers to supercritical, near-supercritical, and nominally-supercritical water which exists at temperatures of 250 deg C.-450 deg C.;

b. introducing high molecular weight hydrocarbon into the reaction chamber under pressure in a continuous manner;

c. maintaining continuously introduced materials consisting essentially of said supercritical water and said high molecular weight hydrocarbon in said reaction chamber and optionally carbon monoxide at operating temperatures of 250° C.-300° C. and at operating pressures between 500 and 2000 psi while said materials are mixed and held inside said chamber for a time of between 25 seconds to about 60 seconds provide a reaction between said high molecular weight hydrocarbon said supercritical water and optionally said carbon monoxide;

d. permitting reaction products to leave said reaction chamber under pressure in a continuous manner.

17. A method for reducing the density, sulfur content, nitrogen content, metal content or any combination thereof, of materials bearing high molecular weight hydrocarbon, comprising:

a. introducing supercritical water into a single flow-through reaction chamber under pressure in a continuous manner, wherein said supercritical water refers to supercritical, near-supercritical, and nominally-supercritical water which exists at temperatures of 250 deg C.-450 deg C. or more;

b. continuously preheating a continuous stream of high molecular weight hydrocarbon;

c. introducing said preheated high molecular hydrocarbon into the reaction chamber under pressure in a continuous manner;

d. maintaining continuously introduced materials consisting essentially of said supercritical water and said high molecular weight hydrocarbon and optionally carbon monoxide in said reaction chamber at operating temperatures between 250° C. and 300° C., at pressures between 500 and 2000 psi, while said materials are mixed and held inside said reaction chamber for a time of between 25 second to about 1 minute, to provide a reaction between the high molecular weight hydrocarbon and the supercritical water; and e. permitting reaction products to leave said reaction chamber under pressure in a continuous manner;

wherein said reaction chamber is a surface-based reactor.

* * * * *